United States Patent [19]

Hughes

[11] 4,269,467

[45] May 26, 1981

[54] ELECTRICAL CONNECTOR RECEPTACLE HAVING MOLDED CONDUCTORS

[75] Inventor: Donald W. K. Hughes, Mechanicsburg, Pa.

[73] Assignee: AMP Incorporated, Harrisburg, Pa.

[21] Appl. No.: 87,379

[22] Filed: Oct. 23, 1979

[51] Int. Cl.[3] ..... H01R 13/405

[52] U.S. Cl. ..... 339/126 R; 29/883; 264/272; 339/176 M; 339/218 M

[58] Field of Search ..... 29/883, 884; 264/272; 339/126 R, 176 M, 191 R, 191 M, 192 R, 217 J, 218 M

[56] References Cited

U.S. PATENT DOCUMENTS

| | | | |
|---|---|---|---|
| 3,850,497 | 11/1974 | Krumreich et al. | 339/126 R |
| 4,045,869 | 9/1977 | Hartmann et al. | 29/884 |
| 4,072,387 | 2/1978 | Sochor | 339/91 R |
| 4,186,988 | 2/1980 | Kobler | 339/176 MP |
| 4,193,654 | 3/1980 | Hughes et al. | 339/91 R |

*Primary Examiner*—John McQuade
*Attorney, Agent, or Firm*—Frederick W. Raring

[57] ABSTRACT

An Electrical Connector Receptacle of the telephone jack type comprises a one-piece housing of insulating material having a plug-receiving opening extending into one end thereof. A plurality of side-by-side stamped and formed conductors are insert molded in the housing. Each conductor has a first end which extends diagonally from one internal sidewall of the opening to the rearward end and which serves as a contact spring. The ends of these springs are captured in slots in a barrier bar which extends across the plug-receiving opening. Intermediate portions of the conductors are embedded in an apron which is integral with one external sidewall of the housing and second ends of the conductors extend laterally from the apron towards the plug-receiving end of the housing. The receptacle is mounted on a circuit board with the plug-receiving end in the plane of the circuit board. The manufacturing method for producing the receptacle is also disclosed.

10 Claims, 10 Drawing Figures

Fig. 1
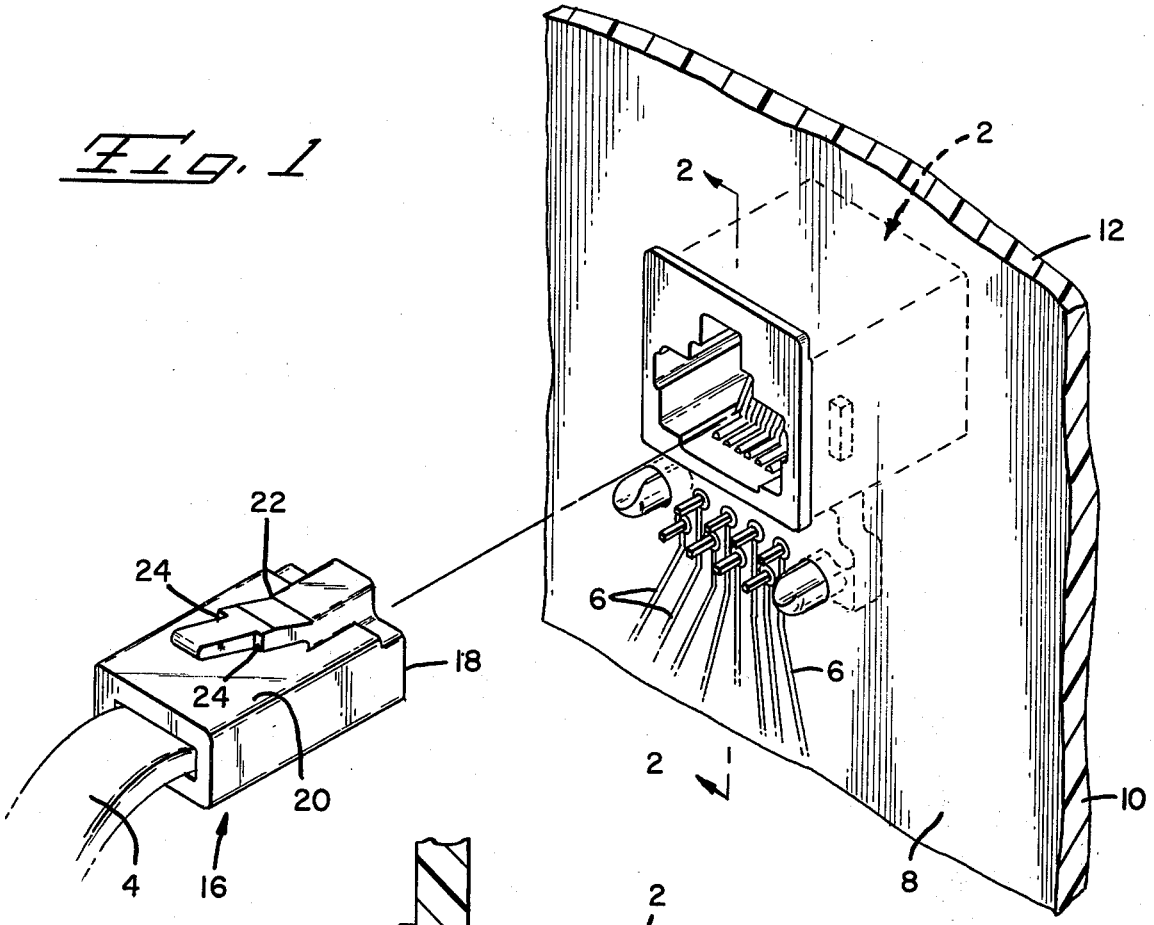
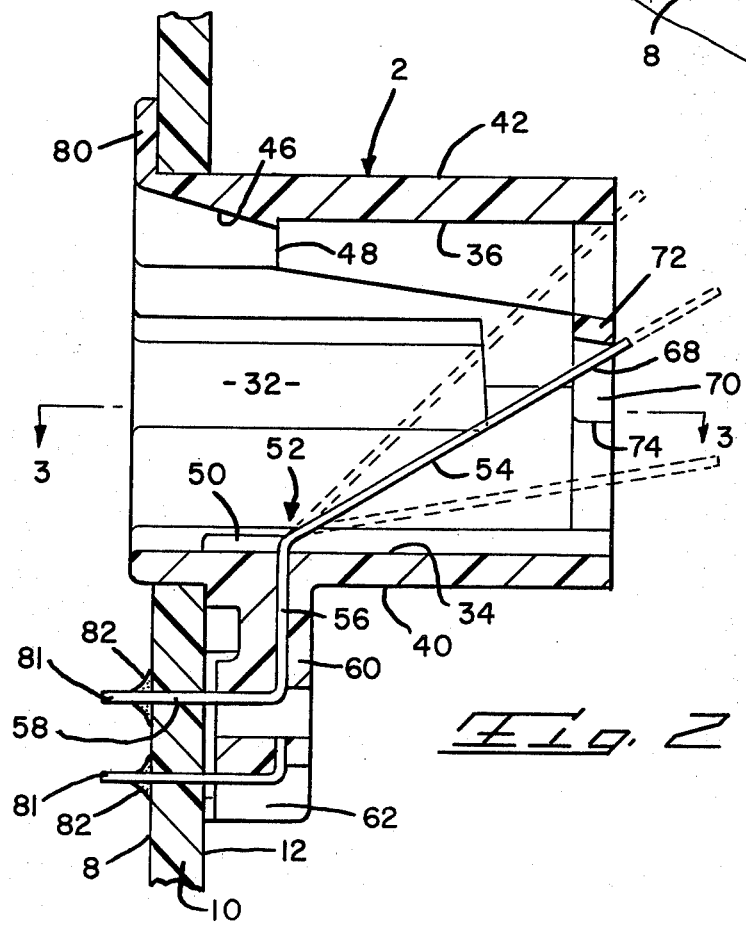
Fig. 2

ELECTRICAL CONNECTOR RECEPTACLE HAVING MOLDED CONDUCTORS

SUMMARY OF THE INVENTION

A widely used type of electrical connector receptacle, which is commonly referred to as a jack, comprises an insulating housing having a plug-receiving opening which is dimensioned to receive a connector plug installed on one end of a cable. A plurality, usually four to eight, of conductors is supported by the housing and has contact spring portions which extend from one of the internal sidewalls of the opening diagonally towards the rearward end of the housing. Intermediate portions of these conductors are supported by the housing and end portions of the conductors are connected to external circuitry. The connector plug has contact members extending to one of its surfaces which engage the contact springs when the plug is inserted into the plug-receiving opening.

The essential dimensions of connector receptacles of the type described above are set forth in a "Report and Order" issued by the Federal Communications Commission and published in the Federal Register of July 12, 1976, pages 28694–28763. The dimensions of these receptacles are set forth in a way such that alternative specific receptacle designs can be produced in conformity with the dimensions. U.S. Pat. No. 3,850,497 shows one type of widely used receptacle in which the conductors are in the form of drawn wires which are inserted through openings in the receptacle housing. It is common practice to connect these wires by crimped connections to stranded wires, which in turn, are connected to external circuits. A typical plug, in accordance with the FCC standards, is disclosed in U.S. Pat. No. 3,954,320.

An alternative type of connector receptacle, in accordance with the FCC U.S. Standards, is disclosed and claimed in Application Ser. No. 969,504, now U.S. Pat. No. 4,231,628, and comprises stamped and formed conductors, rather than drawn wires, which are insert molded in the connector housing so that intermediate portions of the conductors are firmly embedded in the housing. This type of connector receptacle is extremely durable and is resistant to damage during handling when it is placed in service. The connector receptacle shown in Application Ser. No. 969,504, does not, however, have one feature which is required in many jack type receptacles; this feature is in the form of a barrier means at the rearward end of the housing having spaced-apart recesses which receive the ends of the contact spring portions of the conductors. A barrier of this type reduces the possibility of shorting between adjacent conductors in the receptacle and, additionally, constitutes a safety feature in that it prevents insertion of a finger into the plug-receiving opening of the receptacle. The present invention, in accordance with one aspect thereof, is directed to the achievment of a jack type receptacle having conductors insert molded in the receptacle housing and additionally, having a barrier in the rearward end of the plug-receiving opening of the housing.

The invention is directed, in accordance with a further aspect thereof, to the achievement of a jack type receptacle which can be mounted on a circuit board with the plug-receiving end of the receptacle housing in the plane of the circuit board so that the plug is mated with the housing by moving it towards the surface of the circuit board and into the plug-receiving opening. Receptacles, in accordance with the invention, have laterally extending conductor end portions which are received in openings in the circuit board so that they can be soldered to circuits on the circuit board.

The invention is further directed to the achievement of manufacturing techniques involving insert molding of stamped and formed conductors in a receptacle housing and particularly, to molding methods which will permit the achievement of the barrier for the ends of the conductors, as discussed above.

DESCRIPTION OF THE DRAWINGS

FIG. 1 is a fragmentary view of a receptacle in accordance with the invention mounted on a circuit board and showing a plug in alignment with the plug-receiving opening of the receptacle.

FIG. 2 is a cross-sectional view taken along the lines 2—2 of FIG. 1, showing the relationship of the conductors of the receptacle to the receptacle housing.

As shown in FIG. 1, a connector receptacle 2, in accordance with the invention, serves to connect conductors in a jacketed cable 4 to conductors 6 on one surface 8 of a circuit board 10. The receptacle is mounted in an opening 14 in the circuit board with the receptacle housing extending from the other surface 12 of the circuit board. The cable 4 has a plug 16 on its end, the leading end 18 of which is inserted into the receptacle when the cable conductors are to be connected to the circuit board conductors. The plug 16 has a rearwardly extending flexible latch arm 22 on its upper side 20 and this latch arm has spaced-apart shoulders 24 thereon which engage complementary shoulders in the receptacle, as will be described below.

Figure 6:
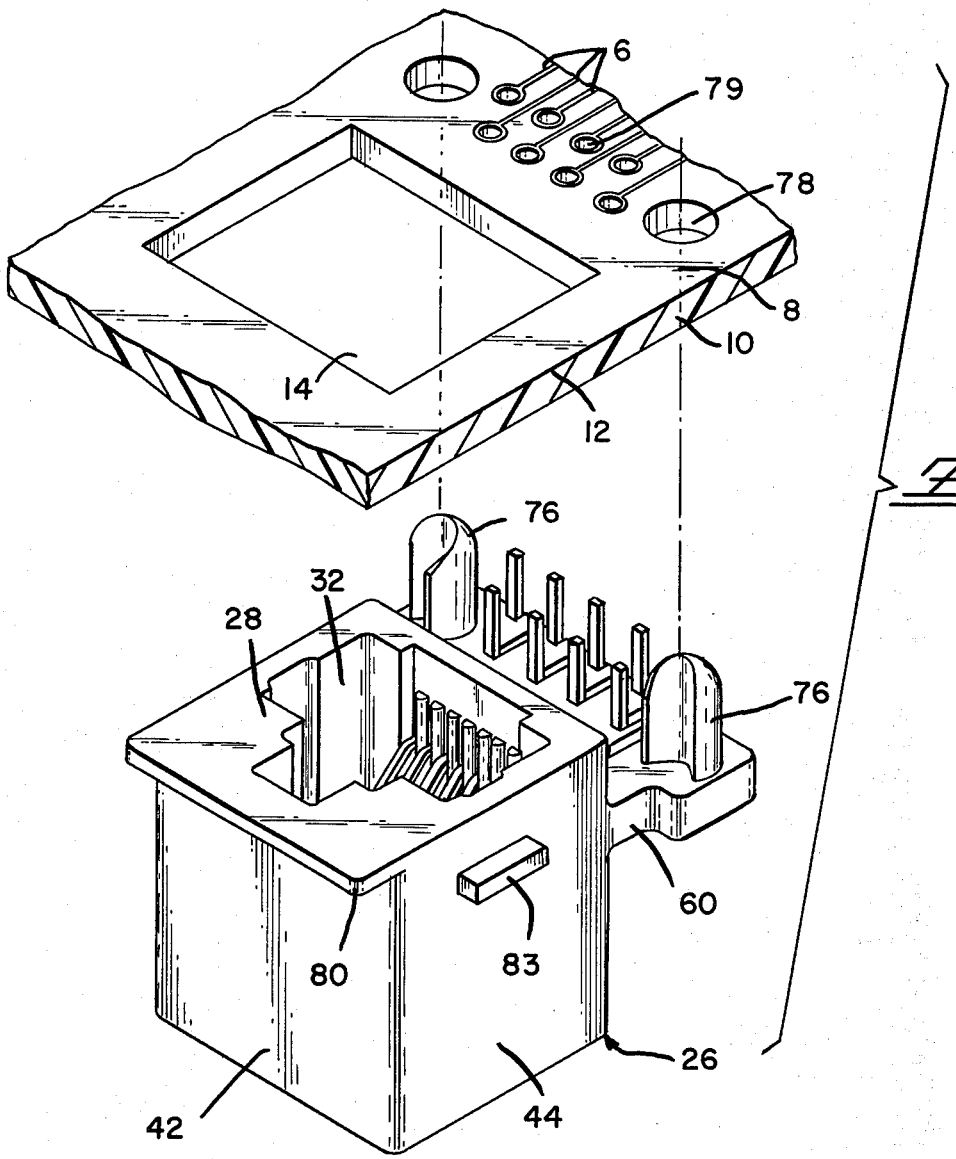
FIG. 6 is a perspective view showing portions of a circuit board and showing a receptacle in alignment with an opening in the circuit board preparatory to assembly of the receptacle to the circuit board.
Figure 3:
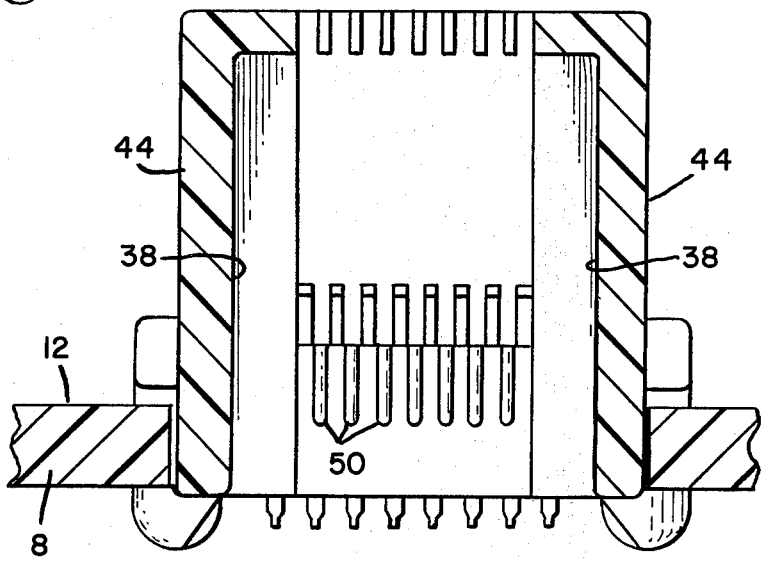
FIG. 3 is a view taken along the lines 3—3 of FIG. 2.

The receptacle 2 comprises an insulating housing 26, FIGS. 2–6, having a plug-receiving end 28, a rearward end 30, and a plug-receiving opening 32, which extends inwardly from the plug-receiving end. The opening 32 has opposed internal sidewalls 34, 36 which are unlike each other and opposed internal endwalls 38, which are substantial mirror images of each other. The external surface of the housing 26 comprises oppositely directed external sidewalls 40, 42 and oppositely directed endwalls 44.

An entrance ramp 46 extends centrally from the plug-receiving end to the internal sidewall 36 and rearwardly directed shoulders 48 are provided on each side of this ramp at the inner end thereof. These shoulders 48 cooperate with the previously identified shoulders 24 to retain the plug in the plug-receiving opening. A plurality of spaced-apart parallel ribs 50 extend from the internal sidewall 34 adjacent to the plug-receiving end of the housing, the dimensions of these ribs being such that it is impossible to insert the plug into the opening 32 if the plug is in an inverted position from that shown in FIG. 1.

A plurality of side-by-side stamped and formed conductors 52 are insert molded in the housing, each conductor having a first end portion 54, an intermediate portion 56, and a second end portion 58. The first end portion 54 of each conductor extends from the internal sidewall 34 diagonally into the opening 32 and towards the rearward end of the housing. These first end portions serve as contact springs and are engaged by the contact members of the plug 16 when the plug is inserted into the receptacle. The intermediate portions 56 of the conductors are embedded in a conductor supporting apron 60 which is integral with, and which extends from, the external sidewall 40 of the housing. The apron extends for the full width of the housing across the external sidewall 40 and has an outer end 66, which is spaced from the sidewall. Alternate deep and shallow slots 62, 64 extend into the apron 60 from the end 66 and the end portions 58 of the conductors 52 are bent laterally and extend through these slots towards the plug-receiving end of the housing.

Each of the first end portions 54, which serve as contact springs, has an outer end 68 adjacent to the rearward end of the housing and these ends 68 are received and captured in side-by-side spaced-apart slots or recesses 70 in a barrier bar 72. The barrier bar 72 is located substantially midway between the internal sidewalls 34, 36 and is integral at its ends with the internal endwalls 38, as shown best in FIG. 4. The slots extend upwardly, as viewed in FIG. 2, from the lower side edge 74 of the barrier bar and the tips 68 of the end portions of the conductors may project slightly beyond the plane of the rearward end of the housing, as was shown in FIG. 2.

The manner of mounting the housing 26 in the circuit board 10 will be apparent from FIG. 6. The housing is positioned in alignment with the rectangular opening 14 of the circuit board and is then inclined slightly so that a flange 80 which extends beyond the external sidewall 42 can be inserted through the opening. Thereafter, the housing is swung towards the underside 12 of the circuit board so that the end portions 58 of the conductors move through holes 79 in the circuit board and mounting posts 76 which extend from the apron 60, move into relatively larger holes 78 in the circuit board. The mounting posts 76 serve only a mechanical function in that they retain the housing on the surface board until the tip portions 81 of the conductors are soldered to pads which surround the holes 79, as shown in FIG. 2 at 82. The posts 76 are preferably of the type described in detail in Application Ser. No. 22,741, filed Mar. 22, 1979, now U.S. Pat. No. 4,195,900. It is desirable to provide ears 83 on the external endwalls 44 which function as stops and support members for the housing.

It will be apparent from an inspection of FIG. 2 that something more than conventional straight-forward insert molding techniques are required to produce connector receptacles in accordance with the invention. As explained above and as shown in FIG. 2, the intermediate portions 56 of the conductors are gripped and firmly embedded in the apron 60 of the housing and the outer ends 68 of the spring portions 54 of the conductors are received in the spaced-apart slots 70 of the barrier bar 72. It should also be mentioned that it is desirable that these spring members 54 be resiliently biased upwardly to the positions shown in FIG. 2, in order to achieve good contact forces at the electrical interface of each conductor and its associated contact member in an inserted plug. The preferred method for manufacturing connector receptacles having embedded conductors with their outer ends captured in a barrier bar, as shown in FIG. 2, will now be described with reference to FIGS. 7–10.

Figure 7:
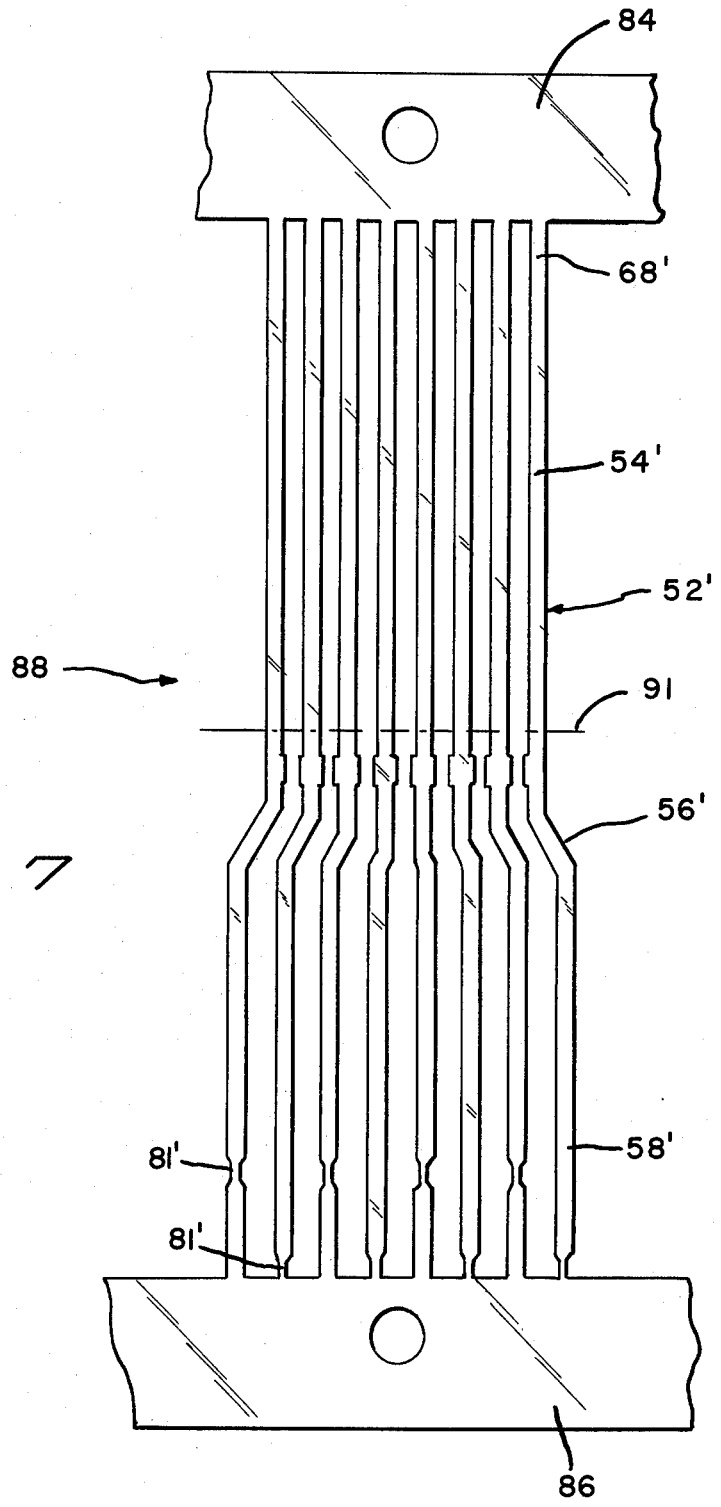
FIG. 7 is a fragmentary plan view of a section of a strip having conductor blanks integral therewith.
Figure 8:
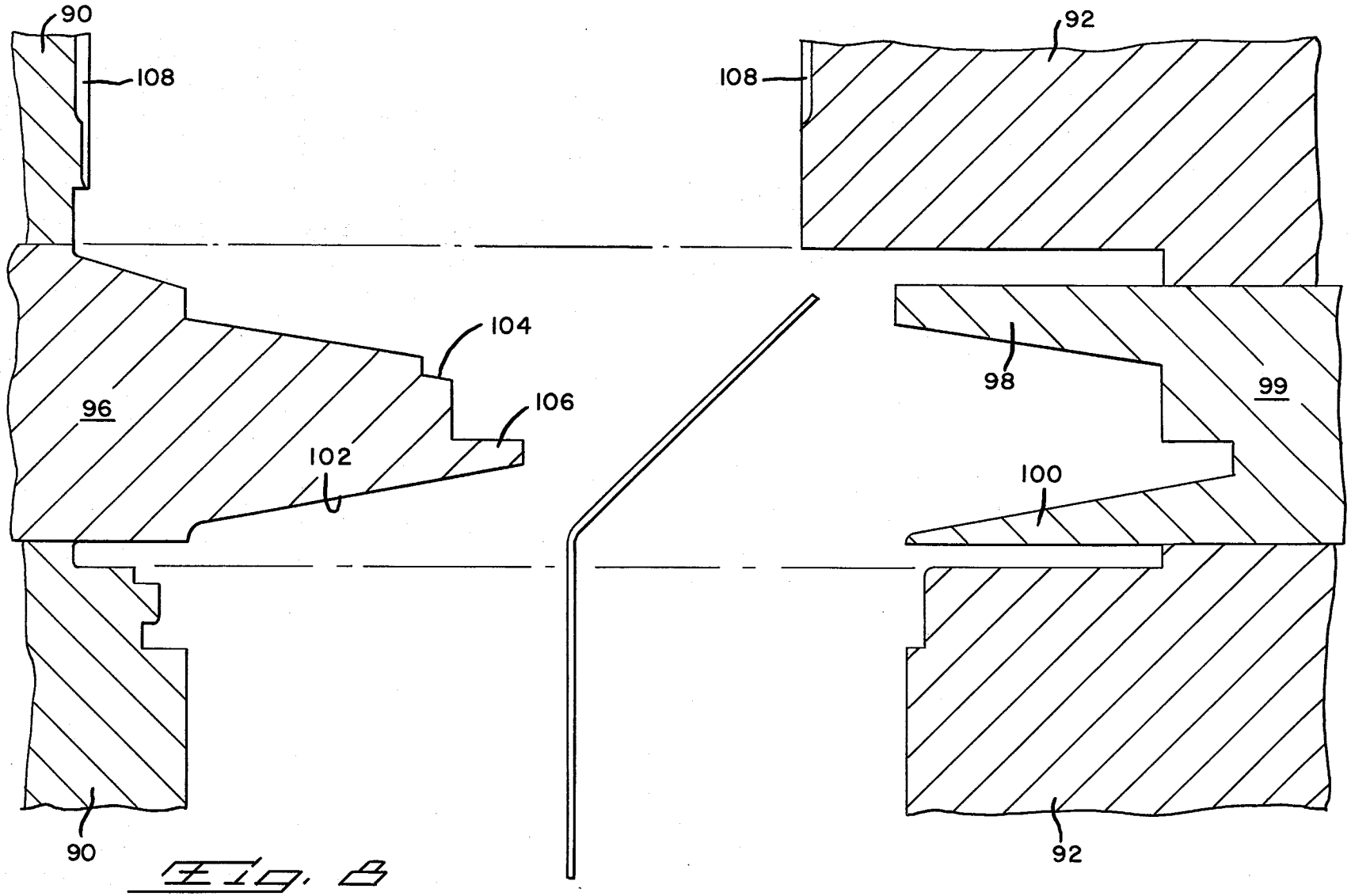
FIG. 8 is a cross-sectional view taken through portions of an injection mold for molding the housing onto a group of conductor blanks, this view showing the two parts of the mold in their open condition.

The conductors 52 are produced by stamping a continuous strip of conductive metal and thereby providing spaced-apart groups 88 of conductors extending between carrier strips 84, 86. The flat blanks 52' in FIG. 7 are identified by the same reference numerals, differentiated by prime marks, as those used to identify the portions of the conductors 52 in FIG. 2. It will be seen that the tips 68' of the contact spring end portions 54' of the conductors are integral with the carrier strip 84. Also, the intermediate portions 5'; of the blanks diverge, with respect to centerline, in order to achieve a greater spacing between the end portions 58' of the blanks, than the spacing between conductors of the contact spring portions 54'. The end portions 58' also have reduced width selections 81' which are adjacent to and spaced from the carrier strip 86 in order to provide alternate long and short conductors, as required by the offset pattern of the conductor ends 58 in the finished receptacle.

Figure 10:
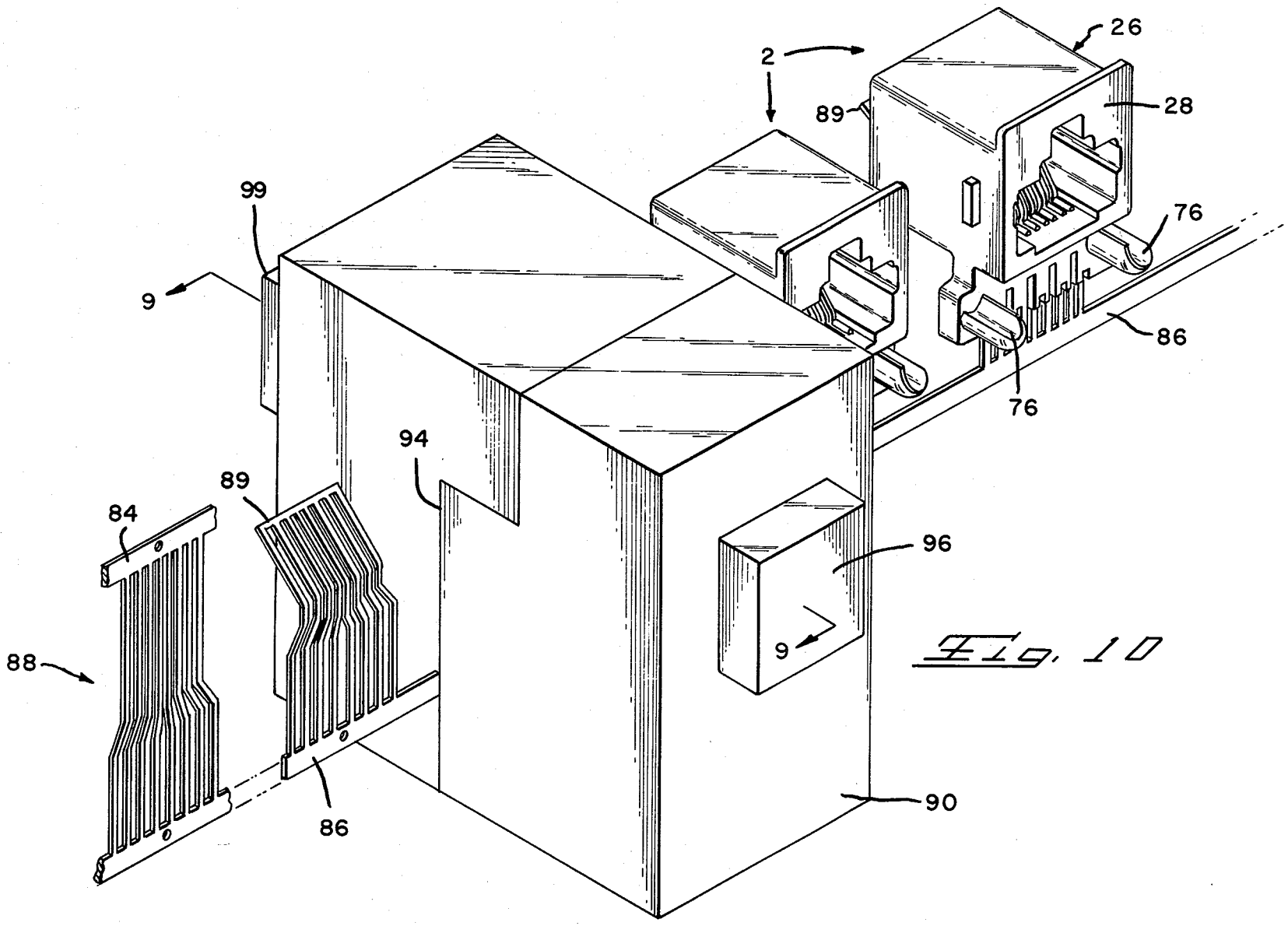
FIG. 10 is a perspective schematic illustration of the molding apparatus for molding the housing onto groups of conductor blanks in accordance with the invention.

Prior to molding of a housing 26 onto a group 88 of conductors, the conductor blanks are bent along a bend line 91, as shown in FIG. 10, in a manner such that the lower carrier strip 86 and the portions 56' and 58' of the conductor blanks lie in one plane and the first end portions 54' extend in a second plane angularly of the first plane. Also, the upper carrier strip 84 is severed on each side of the group of blanks and a portion 89 of the strip is left to serve as a tie bar. This remnant 89 of the carrier strip 84 maintains the end portions 54' of the conductor blanks in spaced relationship with each other while the housing is being molded.

Figure 9:
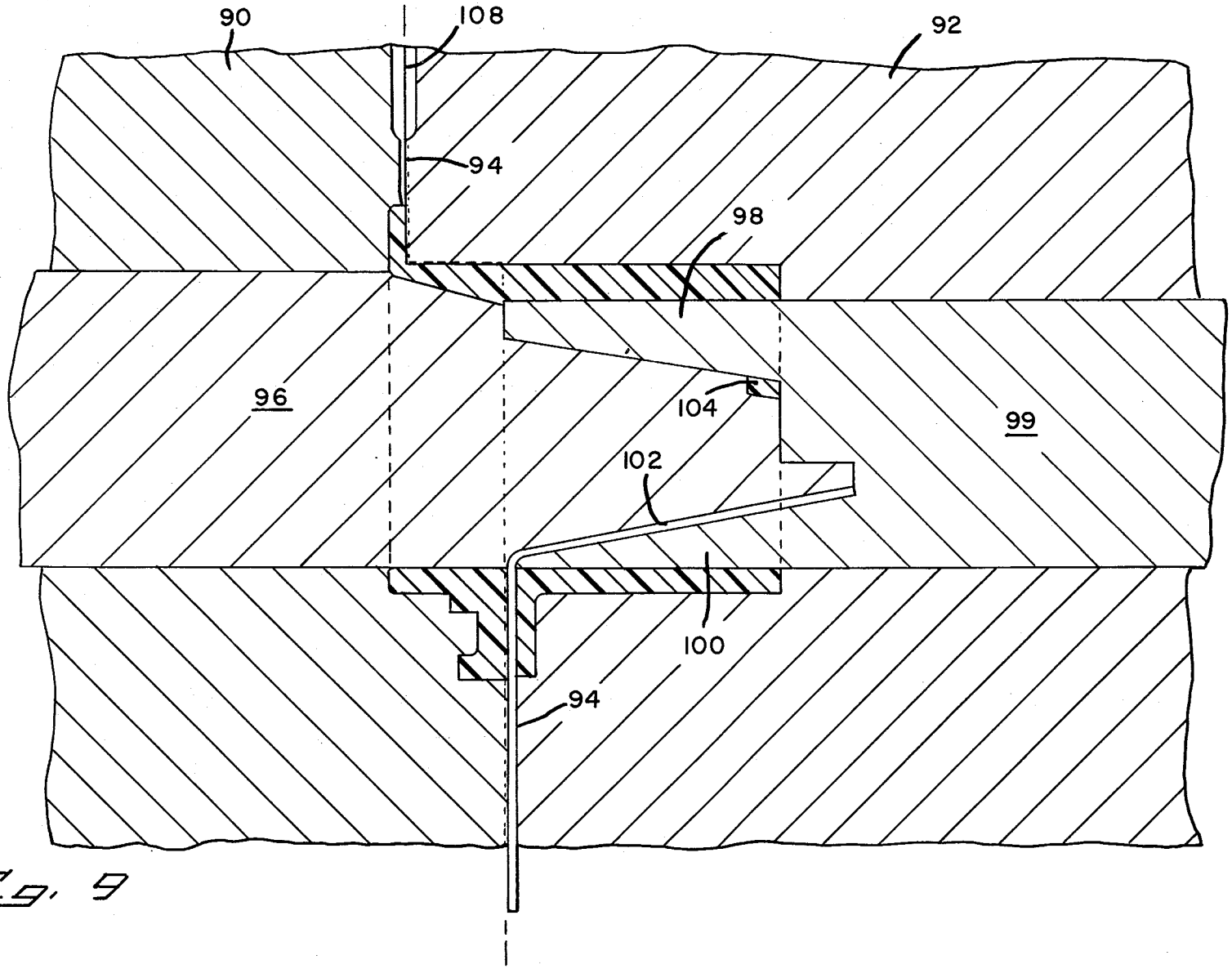
FIG. 9 is a view similar to FIG. 8, but showing the mold parts in their closed positions.

A housing 26 is molded onto a group 88 of conductors by means of an apparatus having two closable mold parts 90, 92 which, when closed, are against each other along a parting line 94, FIG. 9. Molding material is introduced into the mold cavity by means of sprue 108 which is formed at the parting line.

The mold part 90 has a core pin means 96 thereon which extends beyond the parting line and which has an inclined lower surface 102 and a projecting nose portion 106 which is received in a recess in a core pin 99. The core pin 99 in the mold part 92 has complementary projection portions 100, 98 which move against the upper and lower surfaces, as viewed in FIG. 9, of the core pin 96. The portions 100 of the core pin 99 and the surface 102 of the core pin 96 have recesses for the spaced-apart conductors, as is shown in FIG. 9, and the core pin 96 further has recessed surface portions, as shown at 104 for forming the barrier bar 72 and the slots 70.

Figure 5:
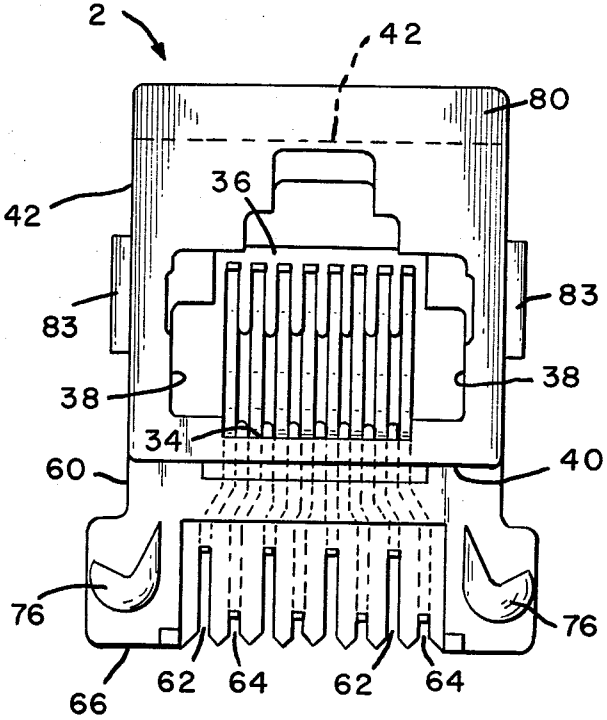
FIG. 5 is a frontal view of the receptacle.
Figure 4:
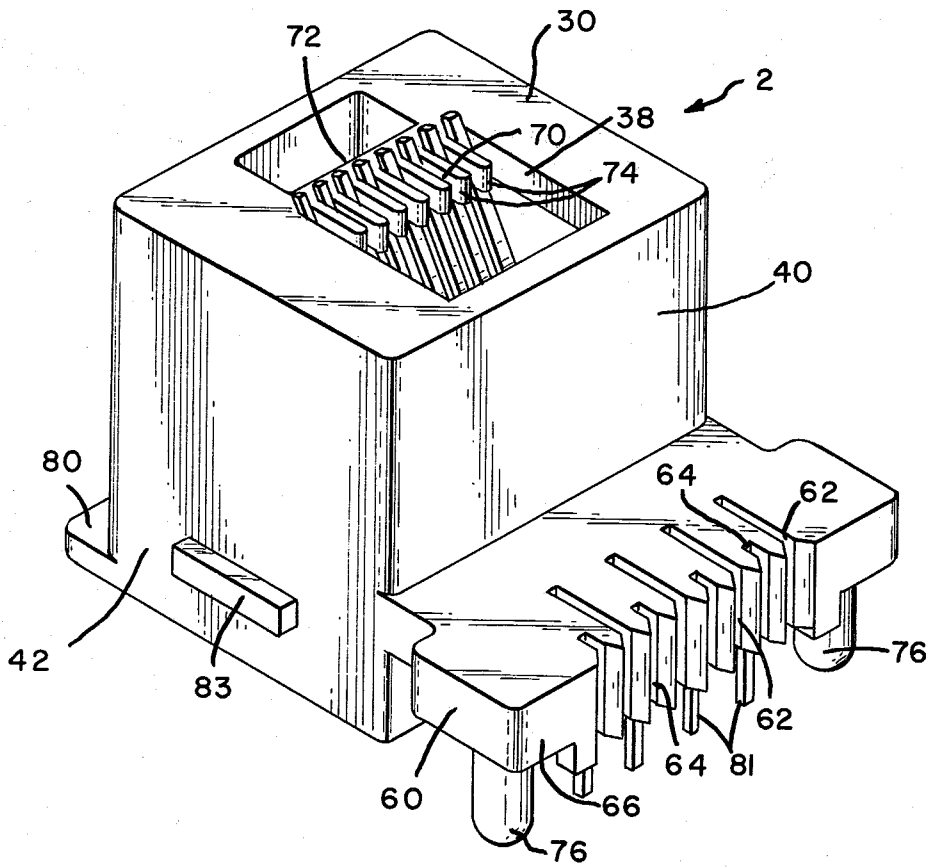
FIG. 4 is a perspective view looking towards the rearward end of a receptacle in accordance with the invention.

After the group of conductors have been fed to a position between the mold parts 90, 92, the parts are moved against each other and during such movement, the projecting section 106 of the core pin 96 will flex the contact spring portions 54' downwardly, as shown in FIG. 9, and the intermediate and end portions 56, 58 of the conductors will be clamped between the mold parts at the parting line 94. The molding material is then injected through the sprue 108 to produce the housing, the mold parts are opened, and the strip is fed from the mold. The contact spring portions 54 of the conductors will then move arcuately upwardly and each conductor will enter one of the slots 70 so that the outer end portion of each conductor is captured in a slot. The tie bar 89 and the carrier strip 86 are then severed from the conductors and the end portions 58 are bent laterally so that they extend towards the mating face of the completed and finished housing as shown in FIGS. 4–6.

The housings can be molded of any suitable plastic material, preferably a thermoplastic, such as polyester, and the conductors may be of any conductive sheet metal, such as brass or beryllium copper, having the requisite spring characteristics. Receptacles in accordance with the invention can be used on circuit boards in a horizontal, as well as a vertical orientation, wherever it is required that the housing be located behind the accessible surface of the circuit board.

A significant achievement of the invention is the provision of a receptacle having insert molded conductors in the housing and, in addition, having a barrier bar at the rearward end of the housing for purposes of safety and electrical performance, as described above. A further advantage is the provision of the apron 60 and the orientation of the end portions 58 of the conductors which permits mounting of the housing on the circuit board with the plug-receiving end in the plane of the circuit board. The barrier bar can, of course, be provided on connector receptacles having other conductor configurations, such as receptacles having the second ends of the conductors extending rearwardly and past the rearward end 30.

I claim:

1. An electrical connector receptacle of the type comprising an insulating housing having a plug-receiving end and a rearward end, a plug-receiving opening extending through said housing from said plug-receiving end to said rearward end, said opening having opposed internal sidewalls and opposed internal endwalls, said housing having oppositely directed external sidewalls and oppositely directed external endwalls, a group of electrical connectors in side-by-side spaced-apart relationship, each of said conductors comprising a first end portion which serves as a contact spring extending from one of said internal sidewalls diagonally into said opening and towards said rearward end, an intermediate portion extending through said housing, and a second end portion which extends externally of said housing, said plug-receiving opening being dimensioned to receive a connector plug having spaced-apart contact members therein which engage said contact springs, said connector receptacle being characterized in that:

said conductors comprise single-piece stamped and formed members, said intermediate portions of said conductors being insert molded in, and being tightly and immovably embedded in, said housing, a barrier bar extending across said opening at said rearward end of said housing, said barrier bar being integral at its ends with said opposed internal endwalls and being located substantially midway between said opposed internal sidewalls, said barrier bar having a plurality of slots therein which extend inwardly from the side edge of said barrier bar which is proximate to said one internal sidewall, said contact springs having free ends which are adjacent to said rearward end of said housing, each of said free ends being received in, and captured by, one of said slots.

2. An electrical connector receptacle as set forth in claim 1, said intermediate portions of said conductors extending from said one internal sidewall through said housing normally of said one internal sidewall and normally of the external sidewall which is adjacent to said one internal sidewall.

3. An electrical connector receptacle as set forth in claim 2, said housing having an integral conductor support apron extending from said adjacent external sidewall, said intermediate portions of said conductors being embedded in said conductor support apron, said second end portions of said conductors extending laterally of said apron and towards said plug-receiving end of said housing.

4. An electrical connector receptacle as set forth in claim 3, said second end portion of every other one of said conductors being offset, relative to the remaining second end portions of said conductors, towards said adjacent external sidewall.

5. An electrical connector receptacle as set forth in claim 4, said conductor support apron having integral mounting means extending therefrom for mounting said housing on a circuit board in an orientation with said plug-receiving end in the plane of said circuit board, said mounting means extending parallel to said second end portions of said conductors.

6. An electrical connector receptacle as set forth in claim 1, said receptacle having been made by the steps of stamping a continuous strip of conductive sheet metal to produce a continuous carrier strip having groups of conductor blanks extending therefrom at spaced intervals, bending said conductor blanks of one group so that said contact portions lie in a plane which extends obliquely of said intermediate portions and said second end portions, molding said housing onto said intermediate portions of said one group of conductor blanks and retaining said contact portions and said carrier strip between said barrier bar and said one internal sidewall during the molding process whereby after molding, said contact portions and said carrier strip are retained between said one internal sidewall and said barrier bar.

7. An electrical connector receptacle of the type comprising an insulating housing having a plug-receiving end and a rearward end, a plug-receiving opening extending through said housing from said plug-receiving end to said rearward end, said opening having opposed internal sidewalls and opposed internal endwalls, said housing having oppositely directed external sidewalls and oppositely directed external endwalls, a group of electrical conductors in side-by-side spaced-apart relationship, each of said conductors comprising a first end portion which serves as a contact spring extending from one of said internal sidewalls diagonally into said opening and towards said rearward end, an intermediate portion extending through said housing, and a second end portion which extends externally of said housing, said plug-receiving opening being dimensioned to receive a connector plug having spaced-apart contact members therein which engage said contact springs, said connector receptacle being characterized in that:

said housing comprises a one-piece molding, said conductors comprise single piece stamped and formed members, portions of said conductors being insert molded in, and tightly and immovably embedded in, said housing, said housing having an integral conductor support apron extending normally from the external sidewall which is adjacent to said one internal sidewall, said intermediate portions of said conductors extending through said conductor support apron, said second end portions of said conductors extending from said support apron at the free end thereof and towards said plug-receiving end.

8. An electrical connector receptacle as set forth in claim 7, said second end portion of every other one of said conductors being offset, relative to the remaining second end portions of said conductors, towards said adjacent external sidewall.

9. An electrical connector receptacle as set forth in claim 8, said conductor support apron having integral mounting means extending therefrom for mounting said housing on a circuit board in an orientation with said plug-receiving end in the plane of said circuit board, said mounting means extending parallel to said second end portions of said conductors.

10. A method of making electrical connector receptacles of the type comprising an insulating housing having a plug-receiving end and a rearward end, a plug-receiving opening extending into said plug-receiving end, said opening having opposed internal sidewalls and opposed internal endwalls, said housing having oppositely directed external sidewalls and oppositely directed external endwalls, a group of electrical conductors in side-by-side spaced-apart relationship, each of said conductors comprising a first end which serves as a contact spring extending from one of said internal sidewalls diagonally into said opening and towards said rearward end, an intermediate portion extending through said housing and a second end portion which extends externally of said housing, a barrier bar extending across said opening at said rearward end of said housing, said barrier bar being integral at its ends with said opposed internal endwalls and being located substantially midway between said opposed internal sidewalls, said barrier bar having a plurality of slots therein which extend inwardly from the side edge of said barrier bar which is proximate to said one internal endwall, said contact springs having free ends at said rearward end of said housing, each of said free ends being received in, and captured by, one of said slots, said method comprising the steps of:

stamping a continuous strip of conductive sheet metal to produce a continuous carrier strip having groups of conductor blanks extending therefrom at spaced intervals, bending said conductor blanks of each group so that said contact portions lie in a plane which extends obliquely of said intermediate portions and said second end portions of said blanks, feeding said strip to a molding apparatus comprising two mold parts which are movable against each other and which have cavity means defining a cavity for said housing and core pin means defining cavity means for said barrier bar, closing said mold parts in surrounding relationship to one of said groups of conductor blanks and, during closing of said mold parts, flexing said contact portions away from the core pin means which defines said barrier bar and towards the side of the mold cavity which defines said one external sidewall, and injecting molding material into said mold cavity, opening said mold parts, and removing a molded housing from said molding apparatus having said contact portions of said conductors and said carrier strip retained between said barrier bar and said one internal sidewall.

* * * * *